United States Patent [19]

Matthews et al.

[11] 3,940,302

[45] Feb. 24, 1976

[54] NON-WOVEN MATERIALS AND A METHOD OF MAKING THEM

[75] Inventors: Kenneth Gerald Matthews; John Richardson, both of Pontypool, England

[73] Assignee: Imperial Chemical Industries Limited, London, England

[22] Filed: Feb. 4, 1975

[21] Appl. No.: 546,984

Related U.S. Application Data

[62] Division of Ser. No. 337,465, March 2, 1973.

[30] Foreign Application Priority Data

Mar. 2, 1972 United Kingdom ..... 9803/72

[52] U.S. Cl. ..... 156/167; 19/155; 156/178; 156/181

[51] Int. Cl.[2] ..... D04H 3/08

[58] Field of Search ..... 156/167, 166, 176, 179, 156/178, 180, 181, 296, 306; 428/296, 288; 264/176 F; 19/155; 28/1 SM

[56] References Cited

UNITED STATES PATENTS

| | | | |
|---|---|---|---|
| 2,738,298 | 3/1956 | David et al. | 156/181 |
| 3,449,187 | 6/1969 | Bobkowicz | 156/178 |
| 3,511,747 | 5/1970 | Davies | 156/181 |
| 3,551,271 | 12/1970 | Thomas et al. | 428/296 |
| 3,639,195 | 2/1972 | Sanders | 156/181 |
| 3,719,546 | 3/1973 | Parlin | 156/177 |

*Primary Examiner*—Douglas J. Drummond
*Assistant Examiner*—Michael W. Ball
*Attorney, Agent, or Firm*—Cushman, Darby & Cushman

[57] ABSTRACT

A non-woven web contains bicomponent filaments having a core of polypropylene and a sheath of specified copolyamides, together with polypropylene homofilaments, in which is embedded parallel yarns extending in its lengthwise direction. The yarns are composed of bicomponent filaments having a copolyamide sheath. The combination of properties of the product makes it suitable for use as a primary backing for tufted carpets.

14 Claims, 3 Drawing Figures

NON-WOVEN MATERIALS AND A METHOD OF MAKING THEM

This is a division, of application Ser. No. 337,465 filed Mar. 2, 1973.

The invention relates to non-woven materials which have a combination of properties rendering them suitable for use as a primary carpet backing material for tufted carpets. The invention also provides a method for making such materials.

A primary carpet backing is required to be as thin as possible, compatible with acceptable tear strength and dimensional stability (which properties should be maintained after tufting, dyeing and application of a secondary backing), since the properties of a tufted carpet depend at least in part on the quantity of service pile. Pile which is inaccessible for use by virtue of being buried in the carpet backing represents a loss of otherwise useful pile yarn to the carpet manufacture. The primary carpet backing should further be composed of a material which does not stain the pile of the carpet when wet. It should also preferably be capable of being dyed in the same dye bath as that in which the pile is dyed without the necessity of making special provisions in order to reduce "grin through." Again, it should largely retain its tear strength after tufting and also it should be compatible with an adhesive for a secondary backing such as latex.

These requirements are satisfied and the necessary physical properties are readily achieved by a product being a non-woven web comprising continuous filaments laid in a random serpentine manner and consisting of a blend of homofilaments and bicomponent filaments, 20%–65%, preferably 35%–55% of the filaments being bicomponent filaments, said homofilaments consisting of at least partly oriented polypropylene and the bicomponent filaments having two components arranged in a core/sheath relationship, the core component being not less than 30 percent by volume and not more than 80 percent by volume and being composed of at least partly oriented polypropylene, and the sheath being a copolyamide which is capable of being rendered adhesive in pressurized saturated steam at a pressure which leaves the core component substantially unaffected; the said web containing a plurality of equispaced and parallel yarns laid in the lengthwise direction thereof, which yarns are composed of oriented bicomponent continuous filaments having a sheath/core relationship, the sheath component being a copolyamide which can be rendered adhesive in pressurised saturated steam at the pressure required to render the sheath component of the bicomponent filaments of the web adhesive, which steam pressure leaves the core component of the filaments comprising the said equispaced and parallel yarns unaffected, there being at least 80, preferably at least 120 such yarns per meter (measured in the crosswise direction); the structure being bonded together at a multiplicity of bicomponent filament cross-over points.

The homofilaments and bicomponent filaments may be intimately blended throughout the thickness and across the area of the web, but in a preferred embodiment bicomponent filaments are present in a higher concentration at at least one of the surfaces of the product than in the centre of the product. This structure is preferred in carpets since the copolyamide sheath component of the bicomponent filaments can be readily dyed in the same dye-bath as that in which the carpet pile is dyed, whereas polypropylene filaments are less prone to dye-uptake. Thus, the preferred structure is less prone to "grin through" since the number of polypropylene filaments at the surface is reduced.

The configuration of the filaments of the web is such that no overall or predominant directional orientation can be discerned. At the same time the web should have a uniform filament density. The filaments should be at least partially molecularly oriented and preferably the birefringence of the polypropylene core component and homofilaments should be at least 50 percent of the maximum birefringence. A suitable copolyamide for the sheath component of the bicomponent filaments is that obtained from copolymerising 75 percent by weight hexamethylene adipamide with 25 percent by weight $\epsilon$-caprolactam. The denier of the filaments of the web should preferably be from 5 to 20 denier, more preferably 6 to 10 denier.

The equispaced and parallel yarns should be buried within the web thickness but need not be at the mid plane of the web. These yarns provide the product with an exceptional dimensional stability during the severe processing conditions to which the product is subjected during manufacture of a tufted carpet, surprisingly in the widthwise as well as the lengthwise direction.

The thickness of the load-bearing component of the bicomponent filaments of which the yarns are formed, that is, the core component, together with the number of such yarns per unit width should be such that the total product contracts in width by no more than 8 percent, preferably by no more than 5 percent when exposed to steam at atmospheric pressure under a load of 225 g per centimeter width of web. We find that satisfactory results are obtained using for example, a yarn composed of continuous filaments having a core of polyethylene terephthalate and a sheath of a copolyamide composed of 70 percent hexamethylene adipamide and 30 percent $\epsilon$-caprolactam (70/30 nylon 6.6/nylon 6), each filament having a decitex of 6.6 there being 40 such filaments in each yarn twisted to 10 turns per meter, and there being 160 yarns per meter, measured in the crosswise direction of the product. Obviously, other combinations are possible, and we find that, as a general rule with filaments having a polyester core, that the number of threadlines per meter multiplied by the decitex of the core components of each yarn should be greater than 20,000. If the core component is a polyamide this product should be greater than 50,000.

In a preferred embodiment, the filaments of the product are coated with a water-repellant waxy lubricant. This coating acts as a lubricant for the tufting needles and permits the filaments of the material to be pushed apart to allow the needle to pass through the web, and thereby minimises the chance of filament breakage during tufting with a consequent loss of grab strength and tear strength. Furthermore, the water repellency of the coating limits the penetration of a secondary backing such as latex into the material, and thereby tear strength of the product is maintained to a greater extent than if complete penetration of latex occurred. We find that poly siloxanes act as eminently suitable agents, for example a mixture of 50 percent poly (dimethyl siloxane) with 50 percent poly (methyl hydrogen siloxane) such as that marketed by Imperial Chemical Industries Limited as "Silicone Finish M.478."

The coating operation may conveniently be carried out by spraying. The siloxane finish may be supplied for example as a 60 percent aqueous emulsion to a spray gun and in order to ensure rapid polymerisation onto the filament surface, a catalyst may be employed. Conveniently the catalyst may be supplied in aqueous solution or suspension and may be mixed with the siloxane mixture in the spray gun. The level of finish will generally be greater than 0.5 percent on the material.

The siloxanes polymerise to form a cross-linked waxy substance on the surface of each filament and the polymerisation can be accelerated, if desired, by a catalyst.

The products of the invention can be prepared by a process whereby a blend of homofilaments and bicomponent filaments are deposited as a web upon a collector surface in a random serpentine manner with a high concentration of bicomponent filaments at the bottom of the web if desired, a warp of threadlines of continuous bicomponent filaments is thereafter laid on top of the non-woven mixture of homofilaments and bicomponent filaments, whereafter a second non-woven layer of a blend of homofilaments and bicomponent filaments is laid on top of the warp, again, if desired, with a high concentration of bicomponent filaments on the top surface, and the structure thereafter is subjected to a treatment with pressurised saturated steam in a steam chamber fitted with inlet and outlet steam seals, the steam pressure and compacting pressure applied by the seals serving to bond the bicomponent filaments at points of contact.

The blend of filaments may be deposited on the collector surface in a random serpentine manner by means of a bank of aspirating jets (air guns) which is traversed in directions normal to the movement of the surface, said guns being provided with means to impose an advancing-retarding oscillatory motion upon the filaments in the direction of advance of the traversing air gun as they exit from the gun.

If it is desired to make the preferred structure in which there is a high concentration of bicomponent filaments at one or both surfaces, then the first and/or last of the bank of aspirating jets may be adapted to receive and deposit bicomponent filaments in a higher concentration than the remainder of the air guns. Conveniently the first and/or last air guns may receive and deposit 100 percent bicomponent filaments.

In a convenient continuous process the components of the bicomponent and homofilaments are melted, forwarded to a filter pack and extruded simultaneously through orifices contained in the same spinneret plate, cooled, converged and brought into a yarn structure which is drawn between pairs of rolls rotating at different peripheral speeds and forwarded to the air gun to be laid into a web which is then treated with saturated pressurized steam to effect the necessary bonding.

A single spinneret may supply yarn to one or more air guns, and clearly if desired more than one spinneret may be employed. If the first and/or last air guns are to spray only bicomponent filaments, then these may be either selected from a spinneret pack designed to produce both bicomponent filaments and homofilaments, or from a second spinneret through which only bicomponent filaments are extruded.

Since the yarn structure has no spin finish applied to it, as is necessary to ensure good separation of the filaments in the aspirating jet, care must be taken to ensure that the tendency for filaments to lick back on the draw-rolls is minimised. We find that this requirement is met if the surfaces of the rolls are knurled or photo-etched.

The warp of threadlines are supplied from a suitable storage creel, through guide tubes which lead them into the correct positions adjacent to the collector surface. The threadlines should be under sufficient tension to prevent them being deflected by, for example, the air exhaust from the aspirator jet providing the top non-woven layer. A tension of about 20 g is generally adequate.

The structure is bonded in an atmosphere of pressurised saturated steam, the exact pressure depending to some extent upon the exact copolyamide composition from which the sheath of the bicomponent filaments in the non-woven sheet are constituted.

Generally speaking, the steam pressure will be chosen to give a product having a maximum tear strength. However, another feature which needs to be considered is the selvedge strength, since it is the selvedges which may have to support, on stenter pins, the tufted carpet incorporating the backing of the invention during, for example, the drying process following the scouring and dyeing sequences. In order to provide a sufficiently strong selvedge, the bonding pressure may need to be raised somewhat from the pressure required to give optimum tear strength. If, of course, the selvedge is to strengthened in a separate processing step, such as by stitching application of an adhesive, or by bonding the selvedges by a different treatment, then the steam pressure chosen will be that which gives optimum tear strength. For example, when the sheath component of the bicomponent filaments in the non-woven portion of the product is 75/25 hexamethylene adipamide/$\epsilon$-caprolactam, the ratio of core to sheath being 40 to 60 by volume and the ratio of polypropylene filaments to bicomponent filaments being 67:33 by number, the filaments having been drawn to a draw ratio of 2.55:1 and bonded in a steam oven at a seal pressure of 3.27 Kg $cm^{-2}$, then we have found that a pressure of 1.54 Kg $cm^{-2}$ is necessary to ensure adequate selvedge strength and of 1.26 Kg $cm^{-2}$ to give optimum tear strength.

Frequently a plurality of aspirator jets will be used to lay down first and second webs, so that higher productivity can be maintained.

The non-woven web of the product of the invention is composed entirely of synthetic polymeric materials, there being from 10 percent to 30 percent copolyamide and 90 percent to 70 percent polypropylene based on the total weight of the web, but excluding the polyester/copolyamide reinforcing warp threadlines.

A preferred embodiment of the process of the present invention will now be described with reference to the accompanying drawings.

Figure 1:
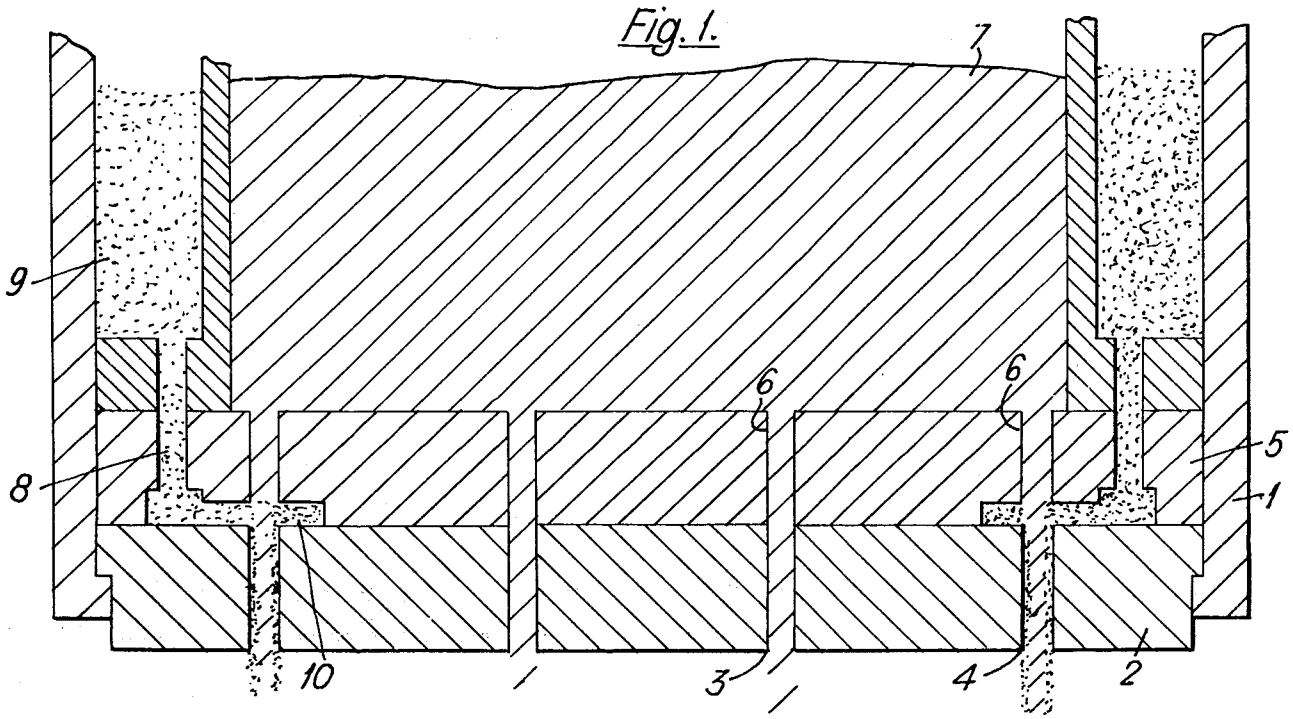
FIG. 1 is a diagrammatic representation of a filter pack and spinneret assembly used in the process of the invention.

In FIG. 1 a spinneret and filter pack assembly 1 comprises a spinneret plate 2 containing extrusion orifices 3 and 4. A distributor plate 5 contains orifices 6 which are axially aligned with extrusion orifices 3 and 4 and which communicate with a first polymer supply chamber 7. Distributor plate 5 also contains polymer supply ports 8 which communicate with a second polymer supply chamber 9 and a recess 10 formed in the underside of the distributor plate and extending beyond pairs of orifices 4 and 6.

The required polymers are metered, in a molten state, into polymer supply chambers 7 and 9 respectively. The polymer from chamber 7, passes through orifices 6 and is extruded through extrusion orifices 3 as homofilaments. Polymer from chamber 9 passes through orifices 8 into recess 10 where it flows around extrusion orifices 4 and is extruded therethrough together with the polymer from orifice 6 as sheath/core bicomponent filaments, the latter polymer forming the core component.

Figure 2:
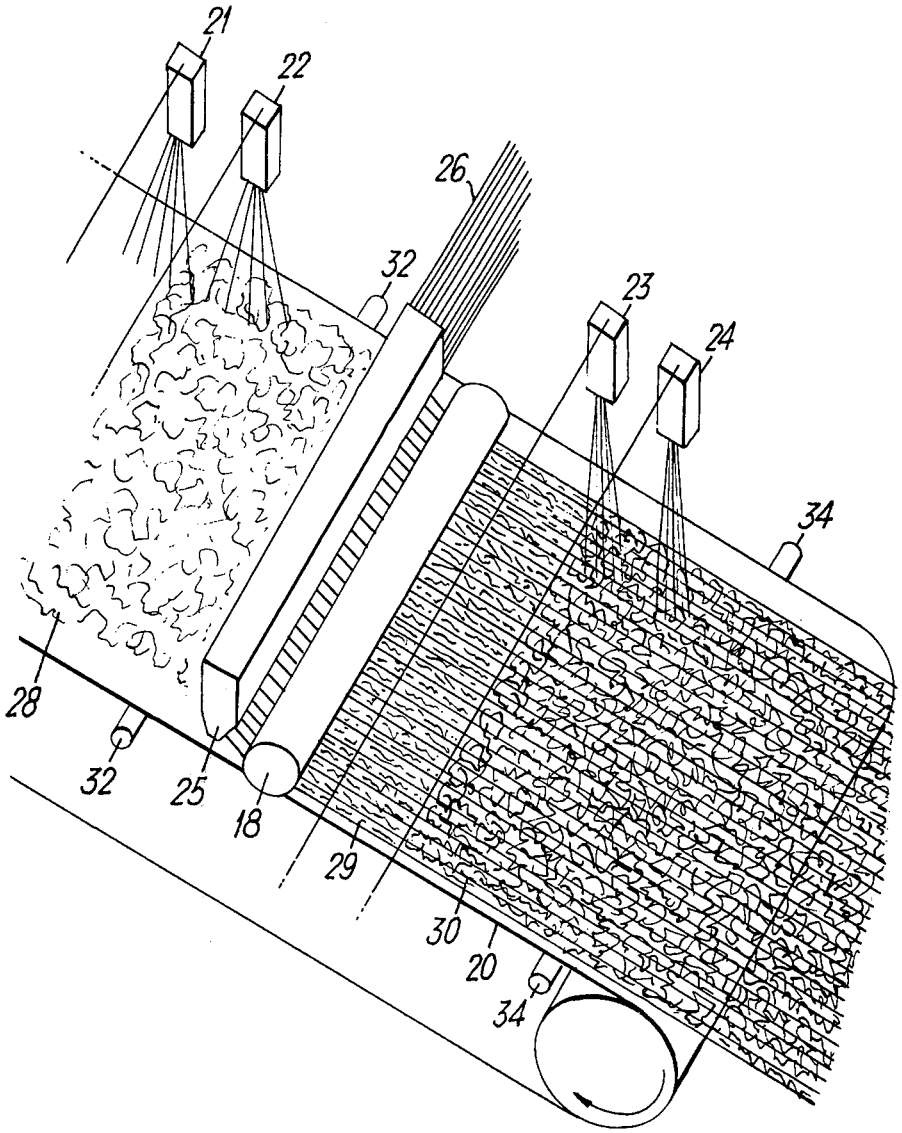
FIG. 2 is a diagrammatic representation of an air gun/collector surface device incorporating means to introduce a warp of threadlines.
Figure 3:
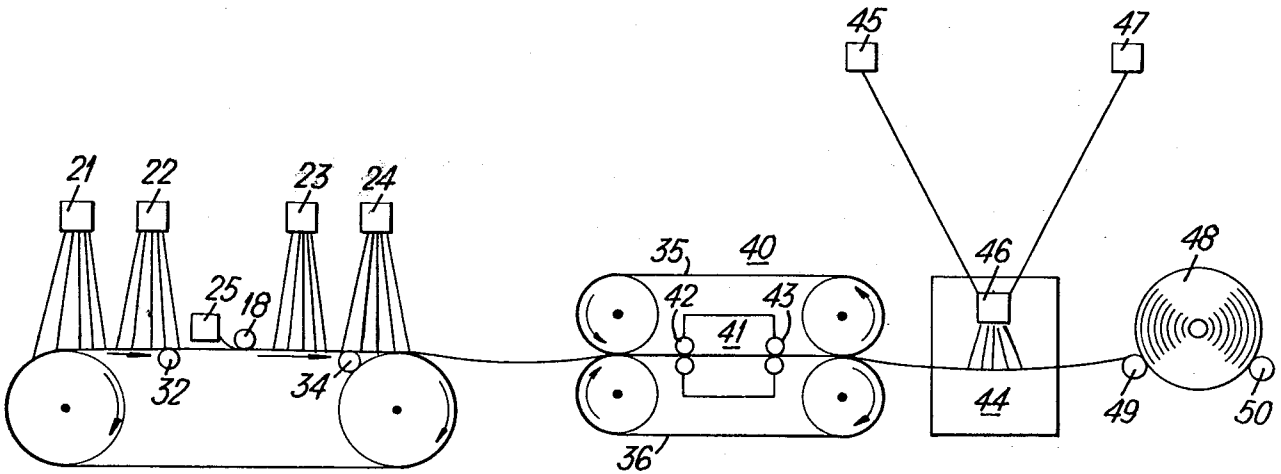
FIG. 3 is a diagrammatic side view of the apparatus used to make the product.

In FIGS. 2 and 3, there is shown a collector surface 20 in the form of an endless belt, which advances in the direction indicated. Air guns 21, 22 and 23, 24 are mounted on a beam (not shown) which is traversed to and fro above collector 20. Beam 25 is mounted above collector 20 and is supplied with a plurality of threadlines 26 from a storage creel (not shown), and is provided with means (not shown) whereby threadlines 26 can be deposited on collector 20 as a regular warp.

Air guns 21, 22 are fed with a mixture of homofilaments and bicomponent filaments which are laid on the collector 20 as a non-woven web 28. In order to avoid any substantial directionality in the filaments it is found necessary to provide air guns 21, 22, 23, 24 with means (not shown) to throw the filaments alternatively in advance and behind the exit nozzle. Upon web 28 the warp 29 of threadlines is laid from a plurality of guide tubes (not shown) supplied by beam 25, and are pressed onto the web by presser roll 18, and this in turn is overlaid by a second non-woven web 30 deposited by air guns 23 and 24.

It it is desired to make the preferred product with concentration of bicomponent filaments at one or both surfaes then air guns 21 and/or 24 will be fed with either a blend of bicomponent filaments and homofilaments with a higher proportion of bicomponent filaments than that supplied to guns 22 and 23 or preferably with bicomponent filaments only. Of course, more than one spray gun may be used to spray 100 percent bicomponent filaments.

In either case it is desirable to treat the web with atmospheric steam in order to discharge the build-up of static electricity. Thus perforated steam-pipes 32, 34 are provided immediately upstream of beam 25, and immediately before the web is separated from collector 20. On leaving collector 20 the web is supported between continuous belts 35, 36 and is passed to bonding oven 40 (FIG. 3) which comprises a steam chest 41 with inlet and outlet seals 42, 43, wherein the copolyamide component of the bicomponent filaments is softened and becomes adhesive. On leavng bonding oven 40, the web is compacted by seal 43 and the adhesive sheath component of the bicomponent filament is brought into contact with adjacent filaments whereby bonds form as the adhesive component hardens.

If desired, the bonded structure may be treated with a polysiloxane lubricant in lubricant chamber 44. Conveniently the polysiloxane is pumped in aqueous solution from storage tanks 45, to spray guns 46 and, if necessary therein mixed with a catalyst pumped from storage tank 47. Finally the product may be wound up as roll 48 driven by rolls 49, 50.

The invention is further described in the following examples which does not limit the scope of the invention.

EXAMPLE 1

Polypropylene, having a Melt Flow Index of 6, when determined according to ASTM - D1238 at 190°C under a load of 2.14 Kg and 6.6/6 (75:25 w/w) copolyamide, the relative viscosity of an 8.4 solution in 90 percent formic acid being 35 is melted in a 7.5 cm diam screw extruder and a standard nylon screw pressure melter respectively. The molten polymers are fed to each of eight packs in the proportions of 75 parts polypropylene: 25 parts copolyamide by weight. The total polymer throughput of each pack is 57 g/min. Six of the eight packs each produce 54 polypropylene homofilaments and 26 polypropylene core — 6.6/6 (75:25) copolyamide sheath, at a core:sheath volume ratio of 40:60, bicomponent filaments. The other two packs each produce 80 polypropylene core — 6.6/6 copolyamide sheath, at a core:sheath volume ratio of 80:20 bicomponent filaments. All spinneret holes are of equal size. The extruded filaments from each pack are quenched in air, and drawn at a draw ratio of 2.55, the surface of the draw rolls being knurled. The 8 filament bundles are electrostatically charged and each bundle passes immediately to a spray gun which is traversed continuously above an advancing stainless wire mesh belt. The two packs producing 100 percent bicomponent filaments feed the last two of the eight spray guns. At the exit of the gun the filaments separate from each other, and are subjected to a secondary air stream which oscillate the filaments in front of, and behind, the exit of the gun in the direction of traverse. The speed of traverse of the guns is 55 m/sec and the filaments are thrown alternatively in front of, and behind, the gun exit at 500 cycles per minute.

The eight spray guns are grouped into two sets, each set having 4 guns. The sets are laterally separated by a beam transverse to the collector, which beam supports a plurality of guide tubes. One end of each tube is positioned a few centimeters above the collector surface and there are 160 such tubes per metre across the entire width of the collector surface. The tubes lead to the vicinity of a creel in which are stored bobbins of drawn continuous filament yarns. The filaments have a core/sheath bicomponent structure, the core being poly(ethylene terephthalate) and the sheath being 66.6 (70/30 w/w) copolyamide, the volume ratio of core to sheath being 50:50. There are 40 such filaments per yarn, which has a count of 300 decitex and a twist level of 10 turns per meter. Each tube receives one yarn and guides it to the vicinity of the collector surface. A bottom web is laid by the guns upstream of the crossbeam, and is treated with atmospheric steam to discharge static electricity from the web before passage under the cross beam. The yarns are pressed onto the surface of the web by the set of spray guns situated upstream from the cross-beam, by passage of the threads under a presser roll. In this way a warp of parallel threadlines is laid on the bottom web, there being 160 threads per meter. This structure is finally overlaid by the web sprayed by the downstream set of spray guns.

The width of the web is 4 m and its weight is 140 g $m^{-2}$. The web is treated with atmospheric steam to aid removal from the wire mesh conveyor and is then bonded by passage through a steam chamber 0.3 m long whilst sandwiched between two fabric conveyor belts. The steam chamber has inlet and outlet steam seals consisting of inflatable air bags as described in British Patent specification No. 1,001,508 which have a compacting action on the web. An air pressure of 3.30 Kg $cm^{-2}$ is maintained in the seals and saturated steam at a pressure of 1.54 Kg $cm^{-2}$ is maintained in the steam chamber under which conditions the copolyamide sheaths of the bicomponent filaments in the structure soften and bonds are formed between contiguous bicompnent filaments.

After bonding, a poly-siloxane lubricant is sprayed onto the web. The lubricant is a mixture of approximately equal parts of poly(dimethyl siloxane) and poly(methyl hydrogen siloxane) in an aqueous emulsion, there being 60 percent by weight of siloxanes in the emulsion. The emulsion is pumped to spray guns and a commercial catalyst (manufactured by Imperial Chemical Industries Ltd., as EP 5865) in aqueous suspension is mixed with the emulsion immediately before spraying. The spray is adjusted to give 1 percent of siloxane on the material. Finally the product is wound up.

The untufted web had grab strengths of 42 and 52 Kg in the machine and cross-machine direction respectively. The web was tufted using an Ellison tufting machine to give 2.6 tufts per cm both in the machine and cross-machine direction. The tufted material was winch dyed and dried in a Stenter at 140°C. At this stage, the tufted fabric had a selvedge strength of 37 Kg. The width contraction occurring in atmospheric steam under a load of 225 g/cm was 4 percent. Latex was applied to the carpet at a rate of 650 g/$m^2$ (dried weight). The finished carpet had grab strengths of 75 Kg and Wing tear strength of 24 Kg in both machine and cross-machine direction.

The parameters referred to in this and the following Examples were measured as follows.

GRAB STRENGTH

A sample of web 17.8 cm long and 20.3 cm wide was clamped between the upper (2.5 cm wide) and lower (5.0 cm wide) jaws of an Instron (Registered Trade Mark) tensile tester. The jaws were initially set at 8 cm apart and moved further apart at a speed of 20 cm/min until the sample broke, the Grab Strength being the load, in kg, applied at break.

SELVEDGE STRENGTH

Measured similarly on a sample taken from the Selvedge, but with stenter pins being used in place of the lower clamp.

WING TEAR STRENGTH

Determined according to the test described in British Specification No. 2576: 1959 — Tear strength by Wing (single nip) tear test.

EXAMPLES 2–23

In this series of Examples, the effect of heterofilament content and bonding pressure on the properties of the non-woven product were examined. In all cases the non-woven products were made by the method of Example 1 with the exception that all aspirating jets sprayed the same blend of homofilaments and heterofilaments and the filaments constituting the non-woven web had a mean denier of 17 denier. The parallel threadlines were spaced and had the same composition as in Example 1. The product was tufted and dyed as in Example 1. The results are given in Table 1 below.

Table 1

| Examples | Bonding pressure: 1–68 kg.$cm^{-2}$ 2 | 3 | 4 | 5 | 6 | 7 |
|---|---|---|---|---|---|---|
| Homofilament/heterofilament ratio | 80:20 | 75:25 | 67.5:32.5 | 60:40 | 50:50 | 0:100 |
| Grab Strength, kg | | | | | | |
| As produced | 18 | 29 | 33 | 34 | 42 | 71 |
| After tufting | 58 | 64 | 67 | 62 | 54 | 28 |
| After tufting and dyeing | 66 | 71 | 73 | 69 | 60 | 37 |
| Wing Tear Strength, kg | | | | | | |
| After tufting and dyeing | 21 | 22 | 23 | 23 | 14 | 4.5 |
| Selvedge Strength, kg | | | | | | |
| After tufting and dyeing | 7.9 | 19.9 | 35 | 45 | 64 | 30 |

At this bonding pressure the products, apart from the 100 percent heterofilament product (Example 7), had good properties before and after tufting and dyeing. Example 2, however, was inferior to the other examples because of its low Selvedge Strength and because the selvedge had bulked up during the dyeing step.

Table 2

| Examples | Bonding pressure: 1–82 kg.$cm^{-2}$ 8 | 9 | 10 | 11 | 12 | 13 |
|---|---|---|---|---|---|---|
| Homofilament/heterofilament ratio | 80:20 | 75:25 | 67.5:32.5 | 60:40 | 50:50 | 0:100 |
| Grab Strength, kg | | | | | | |
| As produced | 19 | 38 | 43 | 51 | 55 | 56 |
| After tufting | 63 | 55 | 62 | 65 | 46 | * |
| After tufting and dyeing | 66 | 70 | 67 | 66 | 55 | * |
| Wing Tear Strength, kg | | | | | | |
| After tufting and dyeing | 21 | 19 | 20 | 20 | 14 | * |
| Selvedge Strength | | | | | | |
| After tufting | | | | | | |

Table 2-continued

| Examples | Bonding pressure: 1–82 kg.cm$^{-2}$ 8 | 9 | 10 | 11 | 12 | 13 |
|---|---|---|---|---|---|---|
| and dyeing | 13 | 14 | 39 | 57 | 59 | * |

At this bonding pressure, the 20 percent heterofilament product (Example 8) had a much improved Selvedge Strength, compared with the sample bonded at lower pressure (Example 2). The 100 percent heterofilament product (Example 13) disintegrated at tufting at this bonding pressure, and at all higher bonding pressures.

Table 3

| Examples | Bonding pressure: 1.96 kg.cm$^{-2}$ 14 | 15 | 16 | 17 | 18 |
|---|---|---|---|---|---|
| Homofilament/heterofilament ratio | 80:20 | 75:25 | 67.5:32.5 | 60:40 | 50:50 |
| Grab Strength, kg | | | | | |
| As produced | 33 | 40 | 65 | 62 | 63 |
| After tufting | 62.5 | 59 | 75 | 61 | 49 |
| After tufting and dyeing | 66 | 64 | 77 | 66 | 56 |
| Wing Tear Strength, kg | | | | | |
| After tufting and dyeing | 21 | 21 | 21.6 | 19 | 14 |
| Selvedge Strength, kg | | | | | |
| After tufting and dyeing | 27.4 | 40 | 53 | 66 | 67 |

Table 4

| Examples | Bonding pressure: 2.11 kg.cm$^{-2}$ 19 | 20 | 21 | 22 | 23 |
|---|---|---|---|---|---|
| Homofilament/heterofilament ratio | 80:20 | 75:25 | 67.5:32.5 | 60:40 | 50:50 |
| Grab Strength, kg | | | | | |
| As produced | 51 | 55 | 64 | 61 | 63 |
| After tufting | 56 | 58 | 69 | 60 | 46 |
| After tufting and dyeing | 75 | 63 | 72 | 67 | 51 |
| Wing Tear Strength, kg | | | | | |
| After tufting and dyeing | 21 | 19.5 | 19 | 16 | 14 |
| Selvedge Strength, kg | | | | | |
| After tufting and dyeing | 37 | 54 | 56 | 58 | 55 |

Further experiments were carried out with a range of bonding pressures using a 50 percent heterofilament web composition.

At bonding pressures less than 1.25 kg.cm$^{-2}$, the web disintegrated during tufting and had very low grab strength and tear strength values before tufting. At pressures in excess of 2.11 kg.cm$^{-2}$ the products could be tufted, but the tear strength was insufficient to withstand the winch dyeing treatment.

EXAMPLES 24–46

This series of Examples illustrate the effect on the properties of the product of using various copolyamides as the sheath component of the heterofilaments, of the non-woven proportions of the webs and indicates the range of bonding pressures at which useful properties are obtained.

In all Examples a 50 percent heterofilament web composition was used, the filaments being 18 denier, and all other conditions being as set out in Example 1.

TAble 5

| Example | 70% Nylon 66/30% Nylon 6 24 | 25 | 26 |
|---|---|---|---|
| Bonding pressure kg.cm$^{-2}$ | 0.63 | 0.84 | 1.05 |
| Grab Strength, kg | | | |
| As produced | 32 | 47 | 67 |
| After tufting | 48 | 37 | 39 |
| After tufting and dyeing | 51 | 53 | 44 |
| Wing Tear Strength, kg | | | |
| After tufting and dyeing | 17 | 17 | 13 |
| Selvedge Strength, kg | | | |
| After tufting and dyeing | 36 | 42 | 49 |

At bonding pressures less than 0.6 kg.cm$^{-2}$ the Grab and Selvedge strengths of the produce were unacceptably low after dyeing whilst at pressures greater than 1.10 kg.cm$^{-2}$ the Tear Strength deteriorated rapidly.

Table 6

| Example | 80% Nylon 66/20% Nylon 6. 27 | 28 | 29 |
|---|---|---|---|
| Bonding pressure kg.cm$^{-2}$ | 2.03 | 2.24 | 2.45 |
| Grab Strength, kg | | | |
| As produced | 19 | 39 | 39 |
| After tufting | 46 | 34 | 44 |
| After tufting and dyeing | 44 | 63 | 46 |
| Wing Tear Strength, kg | — | 21 | 11 |
| Selvedge Strength, kg | — | 25 | 46 |

Table 7

| Examples | 75% Nylon 66/25% Nylon 6. 30 | 31 | 32 | 33 | 34 |
|---|---|---|---|---|---|
| Bonding pressure kg.cm$^{-2}$ | 1.25 | 1.68 | 1.82 | 1.96 | 2.10 |
| Grab Strength, kg | | | | | |
| As produced | 38 | 42 | 56 | 63 | 63 |
| After tufting | 55 | 54 | 46 | 49 | 46 |
| After tufting and dyeing | 63 | 60 | 55 | 56 | 51 |
| Wing Tear Strength | | | | | |
| After tufting and dyeing | 13 | 14 | 14 | 14 | 14 |
| Selvedge Strength | | | | | |
| After tufting and dyeing | 56 | 65 | 64 | 67 | 55 |

Table 8

| Examples | 30% Nylon 66/70% Nylon 6. 35 | 36 | 37 | 38 |
|---|---|---|---|---|
| Bonding pressure kg.cm$^{-2}$ | .42 | .63 | .84 | 1.05 |
| Grab Strength, kg | | | | |
| As produced | 55 | 52 | 73 | 63 |
| After tufting | 46 | 46 | 46 | 51 |
| After tufting and dyeing | 46 | 43 | 38 | 39 |
| Wing Tear Strength, kg | | | | |
| After tufting and dyeing | 20 | — | — | — |
| Selvedge Strength, kg | | | | |
| After tufting and dyeing | 48 | — | — | — |

Table 9

| Examples | 20% Nylon 66/80% Nylon 6. 39 | 40 | 41 | 42 |
|---|---|---|---|---|
| Bonding pressure | 14 | 17 | 20 | 23 |
| Grab Strength, kg | | | | |
| As produced | 52 | 55 | 60 | 56 |
| After tufting | 48 | 48 | 47 | 44 |
| After tufting and dyeing | 54 | 56 | 54 | 54 |
| Wing Tear Strength | | | | |
| After tufting and dyeing | 16 | 16 | 15 | 15 |
| Selvedge Strength | | | | |
| After tufting and dyeing | 42 | 48 | 53 | 53 |

Table 10

| Examples | 10% Nylon 66/90% Nylon 6. 43 | 44 | 45 | 46 |
|---|---|---|---|---|
| Bonding pressure | 1.61 | 1.82 | 2.03 | 2.47 |
| Grab Strength, kg | | | | |
| As produced | 60 | 52 | 55 | 56 |
| After tufting | 41 | 44 | 41 | 45 |
| After tufting and dyeing | 46 | 51 | 46 | 50 |
| Wing Tear Strength | | | | |
| After tufting and dyeing | 13 | 13.2 | 13 | 12 |
| Selvedge Strength | | | | |
| After tufting and dyeing | 49 | 55 | 52 | 44 |

In Tables 4–9, bonding pressures below the lowest shown gave unacceptably low Selvedge and Grab Strengths after tufting and dyeing. Bonding pressures higher than the highest shown gave poor Tear Strengths.

It is seen that the 75/25 66/6 copolyamide (Table 7) gives the highest Grab Strengths and Selvedge Strengths whilst the Tear Strength value is completely acceptable.

What we claim is:

1. A process for making a bonded non-woven web comprising depositing a blend of homofilaments and bicomponent filaments in a random and serpentine manner on an advancing collector surface, to form a non-woven layer, laying a warp of equispaced and parallel yarns of continuous bicomponent filaments on top of said non-woven layer and thereafter laying a second non-woven layer of a blend of bicomponent filaments and homofilaments, 20%–65% of the filaments of the non-woven layer being bicomponent filaments, said homofilaments, consisting of at least partly oriented polypropylene and the bicomponent filaments having two components arranged in a core/sheath relationship, the core component being not less than 30 percent by volume and not more than 80 percent by volume and being composed of at least partly oriented polypropylene, and the sheath being a copolyamide which is capable of being rendered adhesive in pressurized saturated steam at a pressure which leaves the core component substantially unaffected, and the equispaced and parallel yarns being composed of oriented bicomponent continuous filaments haveing a sheath-/core relationship, the sheath component being a copolyamide which can be rendered adhesive in pressurized saturated steam at the pressure required to render the sheath component of the bicomponent filaments of the web adhesive, which steam pressure leaves the core component of the filaments comprising said equispaced and parallel yarns unaffected, there being at least 80 such yarns per meter (measured in the crosswise direction), and thereafter treating the structure in a steam chamber fitted with inlet and outlet steam seals, the steam chamber being supplied with saturated steam at a pressure which, together with the pressure applied by the seals on the structure serves to bond the bicomponent filaments at points of contact.

2. A process for making a bonded non-woven web as claimed in claim 1, wherein the blend of filaments are deposited on the advancing collector surface in a random serpentine manner by a plurality of aspirating jets which are traversed in a direction normal to the direction of advance of the collector surface.

3. A process for making a bonded non-woven web as claimed in claim 1, wherein the aspirating jets are provided with means to impose an advancing-retarding oscillatory motion on the filaments in the direction of advance of the traversing aspirating jets as the filaments exit from the jet.

4. A process as claimed in claim 2, in which at least one of the surfaces of the non-woven web is provided with a higher proportion of bicomponent filaments than at its central portions, comprising supplying to the aspirator jets which lay the first and/or last layers of web bicomponent filaments in a higher proportion than the remainder of the aspirator jets.

5. A process as claimed in claim 4, wherein the aspirating jets which lay the first and/or last lays of the web are supplied with 100 percent bicomponent filaments.

6. A process as claimed in claim 1, where the equispaced and parallel yarns are supplied via guide tubes which terminate adjacent the collector surface.

7. A process as claimed in claim 1, wherein the equispaced and parallel yarns are supplied under tension.

8. A process as claimed in claim 7, wherein the tension is at least 20 g.

9. A process as claimed in claim 1 wherein the selvedges of the bonded web are further strengthed by stitching, application of adhesive or by a separate bonding treatment.

10. A process as claimed in claim 1, wherein the pressure of the saturated steam is selected to give a maximum tear strength.

11. A process as claimed in claim 1, wherein a water-repellent waxy lubricant is applied to the bonded non-woven web after the bonding treatment.

12. A process as claimed in claim 11, wherein the lubricant is applied by spraying.

13. A process for making a bonded non-woven web comprising depositing a blend of homofilaments and bicomponent filaments in a random and serpentine manner on an advancing collector surface, to form a non-woven layer, laying a warp of equispaced and parallel yarns of continuous bicomponent filaments on top of said non-woven layer and thereafter laying a second non-woven layer of a blend of bicomponent filaments and homofilaments, 20 percent – 65 percent of the filaments of the non-woven layer being bicomponent filaments, said homofilaments, consisting of at least partly oriented polypropylene and the bicomponent filaments having two components arranged in a core/-sheath relationship, the core component being not less than 30 percent by volume and not more than 18 percent by volume and being composed of at least partly oriented polypropylene, and the sheath being a copolyamide of 75 percent hexamethylene adipamide and 25 percent ϵ-caprolactam, which is capable of being rendered adhesive in pressurized saturated steam at a pressure which leaves the core component substantially unaffected, and the equispaced and parallel yarns being composed of oriented bicomponent continuous filaments having a sheath/core relationship, the sheath component being a copolyamide which can be rendered adhesive in pressurized saturated steam at the pressure required to render the sheath component of the bicomponent filaments of the web adhesive, which steam pressure leaves the core component of the filaments comprising said equispaced and parallel yarns unaffected, ther being at least 80 such yarns per meter (measured in the crosswise direction), and thereafter treating the structure in the steam chamber fitted with inlet and outlet steam seals, the steam chamber being supplied with saturated steam at a pressure which, together with the pressure applied by the seals on the structure, serves to bond the bicomponent filaments at points of contact.

14. A process as claimed in claim 13, wherein the pressurized saturated steam is between 1.35 $kg.cm^{-2}$ and 2.11 $kg.cm^{-2}$.

* * * * *